US007388193B2

(12) United States Patent
Li

(10) Patent No.: US 7,388,193 B2
(45) Date of Patent: Jun. 17, 2008

(54) TIME-OF-FLIGHT SPECTROMETER WITH ORTHOGONAL PULSED ION DETECTION

(75) Inventor: Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 256 days.

(21) Appl. No.: 11/157,907

(22) Filed: Jun. 22, 2005

(65) Prior Publication Data

US 2007/0023636 A1 Feb. 1, 2007

(51) Int. Cl.
*H01J 49/40* (2006.01)

(52) U.S. Cl. ..... 250/287

(58) Field of Classification Search ..... 250/287
See application file for complete search history.

(56) References Cited

U.S. PATENT DOCUMENTS 2,642,535 A 6/1953 Schroeder
5,396,065 A 3/1995 Myerholtz et al.
6,020,586 A * 2/2000 Dresch et al. ..... 250/287
6,031,227 A 2/2000 Becker et al.
6,521,887 B1 2/2003 Funsten et al.
6,646,252 B1 * 11/2003 Gonin ..... 250/287
6,683,299 B2 * 1/2004 Fuhrer et al. ..... 250/287
6,983,213 B2 * 1/2006 Wang ..... 250/287
2004/0240843 A1 12/2004 Miller

FOREIGN PATENT DOCUMENTS

WO 2004/085992 A 10/2004

OTHER PUBLICATIONS

EP Application No. 06253151, European Search Report dated Mar. 31, 2008.

* cited by examiner

*Primary Examiner*—Jack I Berman

(57) ABSTRACT

This invention provides an apparatus and method for efficient detection of ions in a time-of-flight mass spectrometer. The apparatus of the invention provides for orthogonal deflection of ions in the flight tube of a time of flight mass spectrometer to a detector or detectors positioned along or in the wall of the flight tube of the mass spectrometer. A method of detecting ions utilizing the apparatus is also provided.

18 Claims, 5 Drawing Sheets

TIME-OF-FLIGHT SPECTROMETER WITH ORTHOGONAL PULSED ION DETECTION

TECHNICAL FIELD

The invention relates generally to ion analysis and more particularly to ion analysis in time-of-flight mass spectrometry.

BACKGROUND OF THE INVENTION

Time-of-flight mass spectrometers are based on the fundamental principal that ions which have the same initial kinetic energy but different masses will separate when allowed to drift down a field free region, e.g., the length of the flight tube in a conventional time-of-flight mass spectrometer. The ions acquire different velocities according to the mass-to-charge ratio of the ions. Accordingly, lower mass ions will arrive at a detector positioned at the end of the flight tube prior to ions of higher mass. The detector detects the ions collecting the data that yields the mass spectrum for the sample. Traditionally, the detection system is located at the end of the flight tube of a linear time-of-flight mass spectrometer opposite the end of the flight tube where the ions are generated.

Because the ions of different mass-to-charge ratios arrive at the detector at different times continual emission of ions from the ion source into the flight tube is problematic as ions with lower masses may over take slower moving higher mass ions emitted earlier. Accordingly, in the conventional time-of-flight mass spectrometer, it is necessary to allow all ions emitted at a given time to reach the detector before emitting more ions for analysis.

Conventionally the sample that passes into the flight tube is not a continual beam of ions. Usually the ion beam is divided into packets of ions at the ion source. The packets of ions are launched from the ion source at one end of the flight tube into the flight tube using a pulse and wait approach. When using the traditional pulse and wait approach, the release of an ion packet from the source is timed to ensure that the lower mass faster ions of a trailing packet do not pass the higher mass and slower ions of a preceding packet and that the ions of the preceding packet reach the detector before any overlap can occur. Accordingly, the period between release of packets is relatively long as compared to the amount of time for the release. This creates a low duty cycle. As ion sources typically generate ions from a sample continuously in the ion source, only a small portion of the ions generated in the ion source are emitted from the source as ion packets and undergo detection. Thus a significant amount of sample material is wasted and typically sensitivity is reduced. Further in the conventional time-of-flight mass spectrometer the ions of a given packet impinge on the detector in a sequential manner. Recovery of the detector between impacts may require at least a small amount of time. Impact of ions on the detector before recovery leads to degraded isotope resolution.

U.S. Pat. No. 5,396,065 describes a method of addressing the low duty cycle problem by generating an encoded sequence for launching packets of ions before sending them to the field-free region. Upon arrival at the detector, the ion signals are decoded and spectra are reconstructed. This method requires fairly complicated hardware and software algorithms.

U.S. Pat. No. 6,521,887 describes using a position sensitive detector at the end of the flight tube in combination with a system to raster the ion beam to enhance efficiency of detection of ions.

However, the need remains for an improved apparatus and method for time-of-flight mass spectrometry.

SUMMARY OF THE INVENTION

The present invention includes an apparatus for analyzing ions comprising a flight tube having a longitudinal main axis (e.g. a main axis of the flight tube), a means for generating ions with a trajectory along the main axis of the flight tube, a means for electrostatic deflection and at least one ion detector. The means for electrostatic deflection is positioned parallel to the main axis of the flight tube. Additionally, means for electrostatic deflection is controllable and has at least one first state of non-deflection and at least one second state of deflection. In the at least one second state of deflection at least a portion of the ions are deflected in a trajectory substantially orthogonal to the main axis of the flight tube. The at least one ion detector is positioned in the flight tube substantially parallel to the main axis such that at least a portion of the ions that are deflected in a trajectory substantially orthogonal to the main axis impinge the detector.

The means for electrostatic detection may comprise an ion detection pulser electrode placed in the flight tube in a position substantially parallel to the longitudinal axis of the flight tube. In some embodiments, the ion detection pulser electrode is paired with a second grid electrode placed in the flight tube such that ions passing along the main axis of the flight tube pass substantially between the two electrodes.

The ion detector may be a position sensitive detector. Additionally the ion detector may be a single detector or a plurality of detectors.

A method of analyzing ions using the apparatus of the invention is also provided.

DETAILED DESCRIPTION OF DRAWINGS

DETAILED DESCRIPTION OF THE INVENTION

The present invention provides an apparatus and method that facilitates detection of ions for selected ions or a group of ions with a range of mass-to-charge ratios. The apparatus is a time-of-flight mass spectrometer which provides for reduced "waiting time" between the launching of packets of ions as compared to conventional time-of-flight mass spectrometry. This provides for increased speed of analysis and increased sensitivity due to more efficient use of the ions formed in the ion source. Further, unlike the conventional time of flight mass spectrometer which has sequential ion detection for a packet of ions, the time-of-flight mass spectrometer of the invention provides for simultaneous ion detection of a packet of ions which facilitates high accuracy for isotope distribution and improves exact mass measurement. Also a mass spectrum may be obtained using the mass spectrometer of the invention without complicated spectrum decoding.

In one embodiment, the detector placement is variable. Variable detection placement allows flexible configuration of the time-of-flight mass spectrometer to adjust resolution and speed parameters to optimize the balance between speed and resolution for a particular analysis in the time-of-flight mass spectrometer. These adjustments can be accomplished without significant hardware and software modification.

Figure 1:
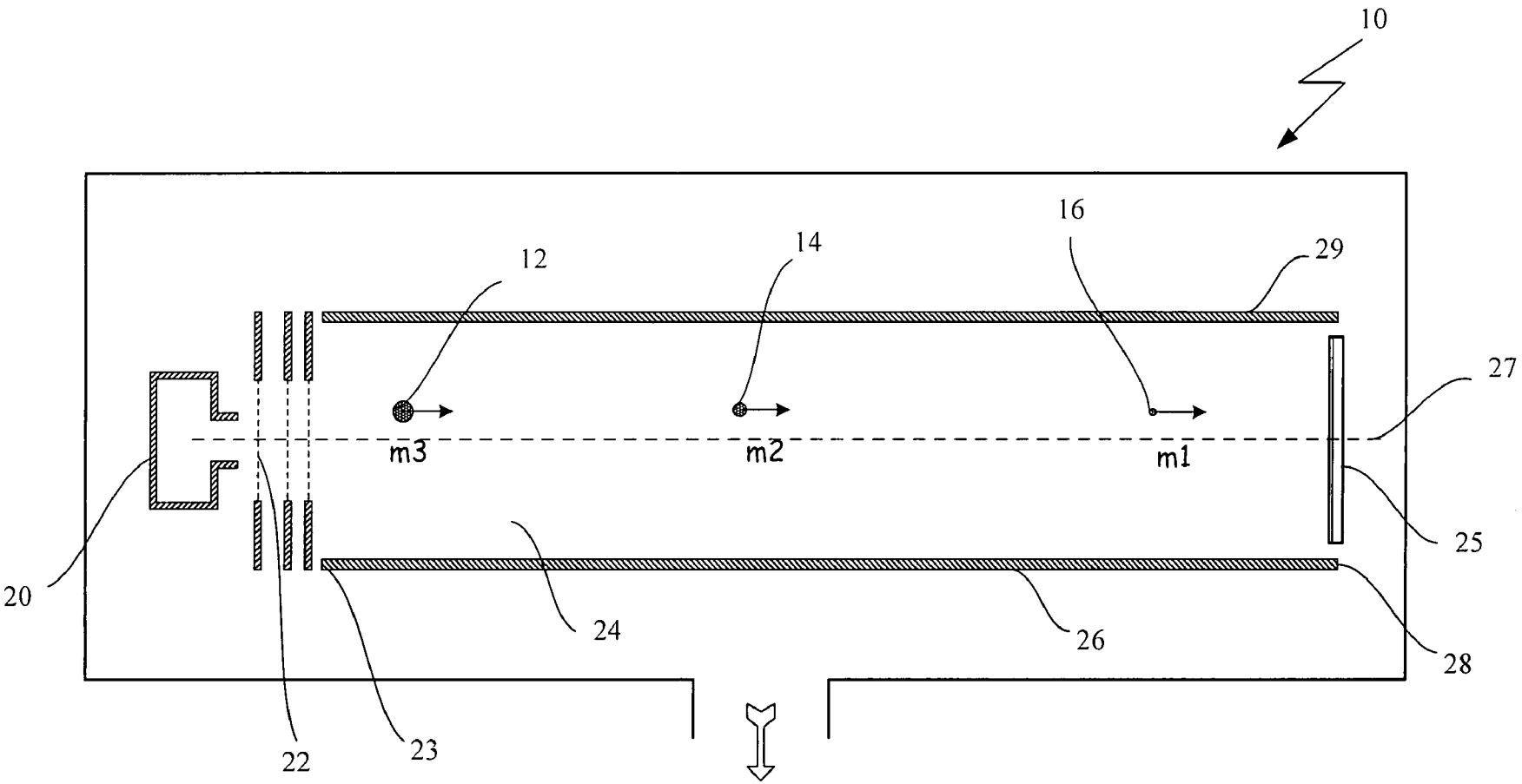
Figure 1 (Prior Art)
FIG. 1 is a schematic diagram of a prior art conventional time-of-flight mass spectrometer.

FIG. 1 depicts a prior art conventional time-of-flight mass spectrometer 10. An ion source 20 located at a first end 23 of flight tube 26 generates ions 12, 14, 16. The ions 12, 14, 16 are sent into an acceleration field 22. Typically the acceleration field 22 is constructed with planar electrodes and mesh grids. When an electrical pulse is applied to the acceleration field 22 a packet of ions containing all mass-to-charge ratios is formed and the packet is accelerated into a field-free region 24 of the flight tube 26. The direction of acceleration of the ion packets is toward a second end 28 of the flight tube 26 in a path substantially parallel to flight tube main axis 27. The flight tube 26 for a conventional time-of-flight mass spectrometer 10 is normally a conductive cylinder with a length substantially longer than its diameter.

In a conventional time-of-flight mass spectrometer an ion detector 25 is placed at the end of the field-free region at the second end 28 of the flight tube 26. For the exemplary ions 12, 14, 16 accelerated by the same electrical pulse, those ions of low mass-to-charge ratios move through the field free region 24 faster than ions of higher mass to charge ratios at the same kinetic energy. As illustrated in FIG. 1, the ion 16 has a mass to charge ratio (e.g. m/z) less than ions 12 and 14 and ion 14 has an m/z ratio less than ion 12. Ions 12, 14, 16 are detected sequentially when they impinge the ion detector 25.

Figure 2:
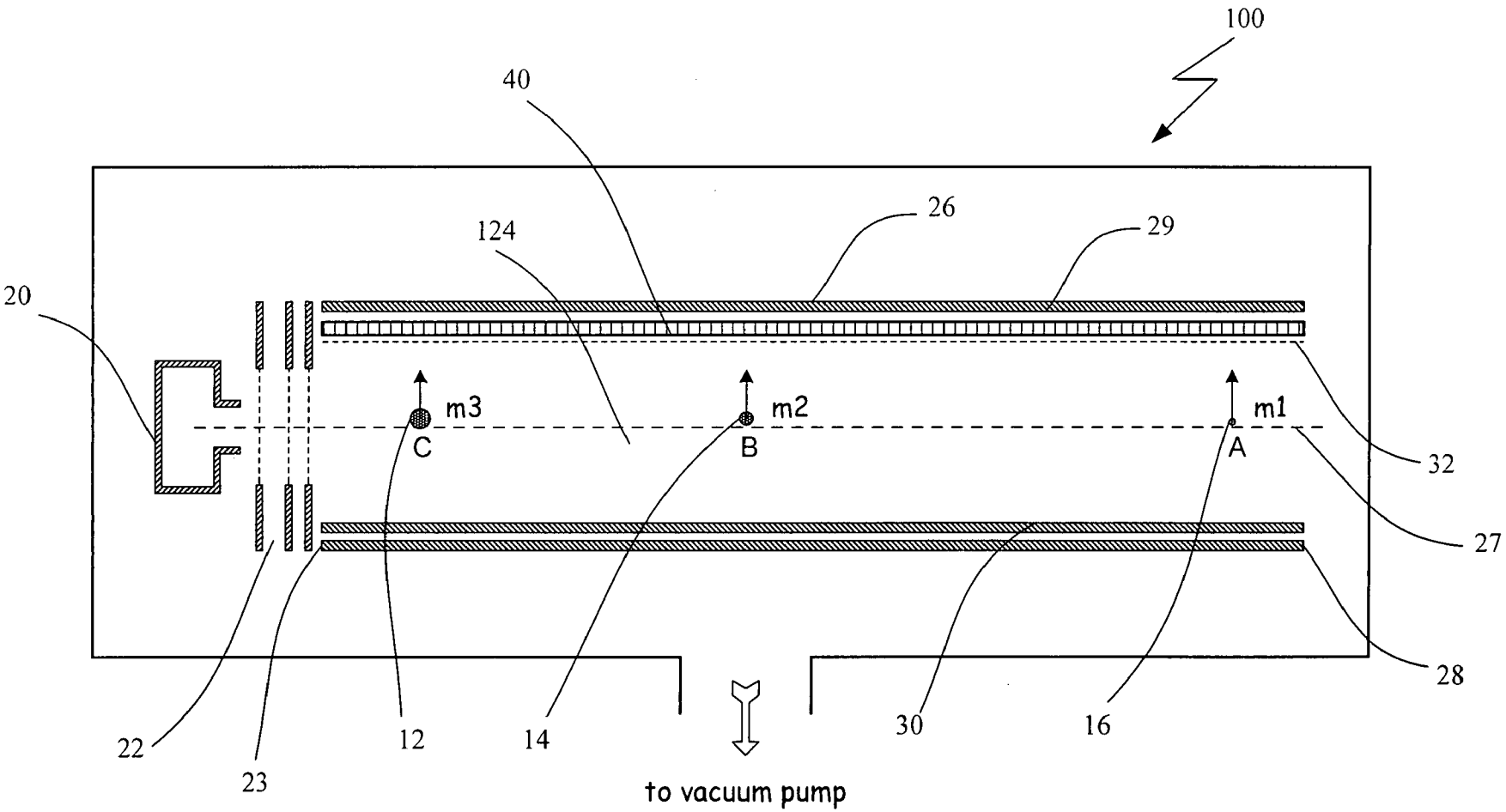
FIG. 2 is a schematic diagram of one embodiment at the time-of-flight mass spectrometer of the invention at the time of application of an electric pulse to the ion detection pulser electrode.

FIG. 2 shows an exemplary embodiment of the time of flight mass spectrometer 100. An ion source 20 generates ions which are sent into an acceleration field 22. The acceleration field 22 may for example, be constructed of planer electrodes and mesh grids. An electrical pulse is applied to the acceleration field 22 and a packet of ions containing all mass to charge ratios generated from the sample is formed and the packet is accelerated into inner region 124 of the flight tube 26. The inner region 124 is field free at the time that the ions enter the inner region 124. The ions exiting the acceleration field 22 (exemplary ions 12, 14, 16 in this example) initially follow a trajectory substantially parallel to flight tube main axis 27 (e.g., initially they follow the same trajectory as in a conventional time-of-flight mass spectrometer). The ion source and acceleration field arrangement are exemplary of an apparatus and method for generating packets of ions. Other apparatus or methods known to those skilled in the art may be suitable for use in the practice of the invention.

In the exemplary embodiment shown in FIG. 2, the flight tube 26 is constructed with a set of electrodes 30, 32 disposed along the flight tube 26. The electrodes being positioned parallel to each other and substantially parallel to flight tube main axis 27. The first electrode 30 is an ion detection pulser electrode. The second electrode 32 is a grid electrode. In one exemplary embodiment, the ion detection pulser electrode 30 is a planer electrode and the grid electrode 32 is constructed with mesh grid or grids. The electrodes are spaced such that ions traveling from the acceleration field 22 at the flight tube first end 23 in a trajectory substantially parallel to the flight tube main axis 27 toward the flight tube second end 28 pass between the ion detection pulser electrode 30 and the grid electrode 32.

The ion detection pulser electrode 30 and mesh grid electrode 32 have a first state and at least one second state. In the first state both the ion detection pulser electrode 30 and grid electrode 32 are at the same potential as the flight tube 26. In this first state, the region between the first and second electrodes 30, 32 in the flight tube 26 is a field-free region. Ions of different mass-to-charge ratios (exemplary ions 12, 14, 16 in this example) travel along the flight tube and separate from each other in space according to their mass-to-charge ratio, as they would in a conventional time-of-flight mass spectrometer. At a time point t, exemplary ion 12 arrives at point A, and exemplary ions 14 and 16 arrive at point B and point C, respectively. At time t, an electrical pulse is applied to the ion detection pulser electrode 30. This creates a second state in which the inner region 124 between the ion detection pulser electrode 30 and the grid electrode 32 is no longer field free, e.g., a transversal acceleration field is established between the ion detection pulser electrode 30 and grid electrode 32. In the second state, as shown in FIG. 2, ions (e.g. exemplary ions 12, 14, 16 in this schematic) are accelerated toward the grid electrode 32 in a trajectory substantially orthogonal to the flight tube main axis 27. A position-sensitive ion detector 40 substantially parallel to the main axis 27 is placed between the grid electrode 32 and the wall 29 of the flight tube 26. The position sensitive detector 40 detects the deflected ions collecting the date that yields the mass spectrum. Alternatively, the detector 40 may be positioned at or in the wall 29.

Typically, the application of the electric pulse to the ion detection pulser electrode 30 (e.g., the ion detection pulse) is synchronized with the application of the electric pulse to the accelerator field 22 (e.g., the ion acceleration pulse) and formation of the packet of ions. The ion detection pulser electrode 30 is shown as a single electrode. Multiple ion detection pulser electrodes may be used and/or the ion detection pulser electrode may be segmented such that ions may be deflected orthogonally at one or more specific points along the flight tube 26. Similarly the grid electrode 32 may be, in some embodiments, multiple electrodes and/or segmented.

The mass-to-charge ratio of the ions impinging on the detector is determined by $$\frac{m}{q} = 2U\left(\frac{t}{L}\right)^2$$

where U is the accelerating voltage applied to ion acceleration field, t is the delay time between the ion acceleration pulse and ion detection pulse, L is the position measured with the position-sensitive detector for the apparatus of the invention (for the conventional time-of-flight instrument in which the detector is positioned at the end of the flight tube opposite the end bearing the ion source, L is the length of the flight tube), m is mass and q is charge.

There is a small additional time delay between the ion detection pulse and ion arrival at the detector 40, so the total delay time is uknown. The instrument is calibrated with a sample with known mass-to-charge ratio $$\left(\frac{m_0}{q_0}\right)$$

to determine a coefficient c $$c = 2Ut^2 = L^2\left(\frac{m_0}{q_0}\right)$$

Thus for examples analyzed in the instrument, the mass-to-charge ratio of an unknown ion is determined by $$\frac{m}{q} = c\left(\frac{1}{L^2}\right)$$

The apparatus and method for ion detection described above can, in some embodiments, yield a higher speed detection e.g. higher speed analysis in comparison to a conventional time-of-flight mass spectrometer 10. For example, in conventional time-of-flight mass spectrometers 10 the time needed for detecting all mass-to-charge ratios is determined by the maximum mass-to-charge ratio of interest. For example, for a conventional time-of flight mass spectrometer 10 with a flight tube of 1 meter, and an ion acceleration voltage of 1000 volts, the detection time in μs for an ion of mass-to-charge ratio 500 is about 49 μs as calculated below:

$$t = 70\sqrt{\frac{m}{U}}\,L[\mu s] = 70\times\sqrt{\frac{500}{1000}}\times 1 = 49[\mu s].$$

In contrast, the time needed for mass analysis in the time of flight mass spectrometer 100 is determined by the lowest mass-to-charge ratio of interest. For instance, if the lowest mass to charge ratio of interest is 5, the time needed for detecting ions of all mass-to-charge ratios is equal to about 4.9 μs as calculated below:

$$t = 70\sqrt{\frac{m}{U}}\,L[\mu s] = 70\times\sqrt{\frac{5}{1000}}\times 1 = 4.9[\mu s].$$

For this illustrative example, the mass to charge analysis is accomplished about 10 times faster in the apparatuses and method described than in a conventional instrument. Accordingly the duty cycle for the illustrative example is increased about 10 fold. This example is exemplary of how analysis time is calculated in conventional instruments 10 and instruments of the invention 100 and values will vary depending on such parameters as flight tube length and the dispositive mass to charge ratio as identified above, for example.

Commercially available position-sensitive detectors may be used in the apparatuses described. However, specially designed or configured detectors are also suitable for use. The mass resolution of the time-of-flight instrument of the invention is determined in a large part by the resolution of the position-sensitive detector. At the time of detection, the separation of a mass-to-charge ratio m and m+Δm is given by $$\Delta L = -\frac{1}{2}\frac{\Delta m}{m}L = -\frac{1}{2}\frac{\Delta m}{m}\left(0.014\sqrt{\frac{U}{m}}\,t\right)$$

with t in μs. For separation of mass-to-charge ratio of m=500 and m+Δm=501, $$\Delta L = -\frac{1}{2}\frac{\Delta m}{m}L = -\frac{1}{2}\frac{\Delta m}{m}\left(0.014\sqrt{\frac{U}{m}}\,t\right) = -$$

$$\frac{1}{2}\times\frac{1}{500}\times 0.014\times\sqrt{\frac{1000}{500}}\times 4.9 = 1\times 10^{-1}[m] = 100[\mu m].$$

Thus, for this representative example, a position-sensitive detector with a resolution of 100 μm is required for detection of m=500 and m+Δm=501. Such a detector is commercially available for example, through Del Mar Ventures (4119 Twilight Dr., San Diego, Calif. 92103, USA).

Figure 3:
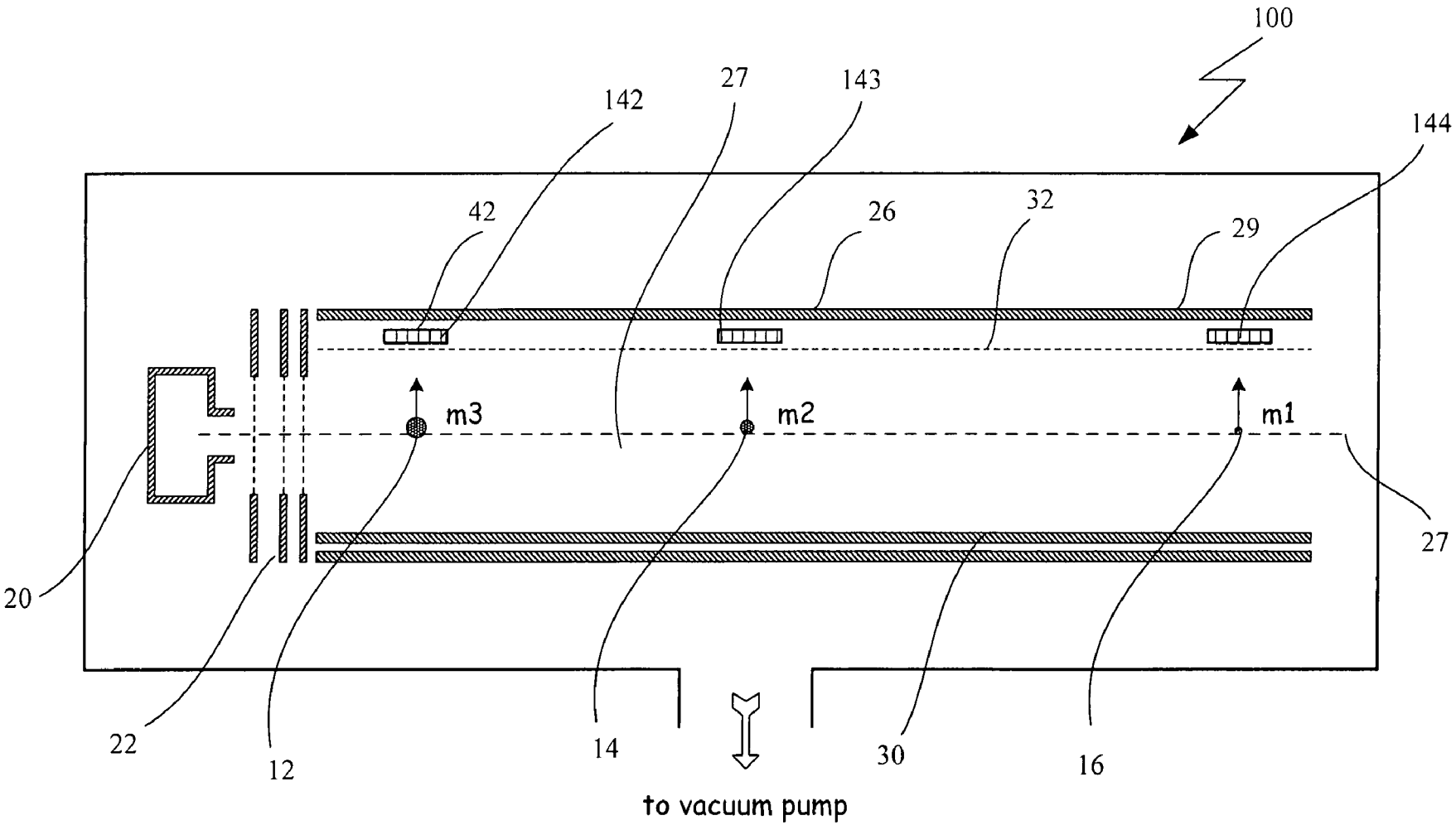
FIG. 3 is a schematic diagram of one embodiment of the time-of-flight mass spectrometer of the invention having a plurality of detectors at the time of application of an electric pulse to the ion detection pulser electrode.

In one exemplary embodiment of the time of flight mass spectrometer of the invention 100, a position-sensitive detector is not necessarily needed. As shown in FIG. 3, the detector 42 is segmented. The segmented detector 42 may include a plurality of short detector portions 142, 143, 144 of linear type disposed along the flight tube 26 at positions selected for detecting ions of certain mass-to-charge ratios of interest. Several positions-sensitive detectors or a single position sensitive detector physically divided into segments may form the detector portions 142, 143, 144 in some embodiments. Alternatively, small conventional detectors may be suitable in some applications to form detector portions 142, 143, 144. Three detector portions 142, 143, 144, as shown in FIG. 3, is exemplary. A segmented detection 42 will have at least two detector portions but may have more. The use of the term segmented detector herein should be taken to include a plurality of detector portions which may comprise a plurality of conventional detectors, a plurality of position sensitive detectors or a combination thereof. Further, the plurality of detector portions may be individual detectors or derived by physically dividing a single detector into sections. Use of either conventional or small position sensitive detectors may offer the advantage of reduced instrument cost. In embodiments with segmented a detector 42, the detector portions 142, 143, 144 may have the same or different resolutions. For example, for detecting ions of low mass-to-charge ratio, a lower resolution detector may be used than for detecting higher mass ions.

Figure 4:
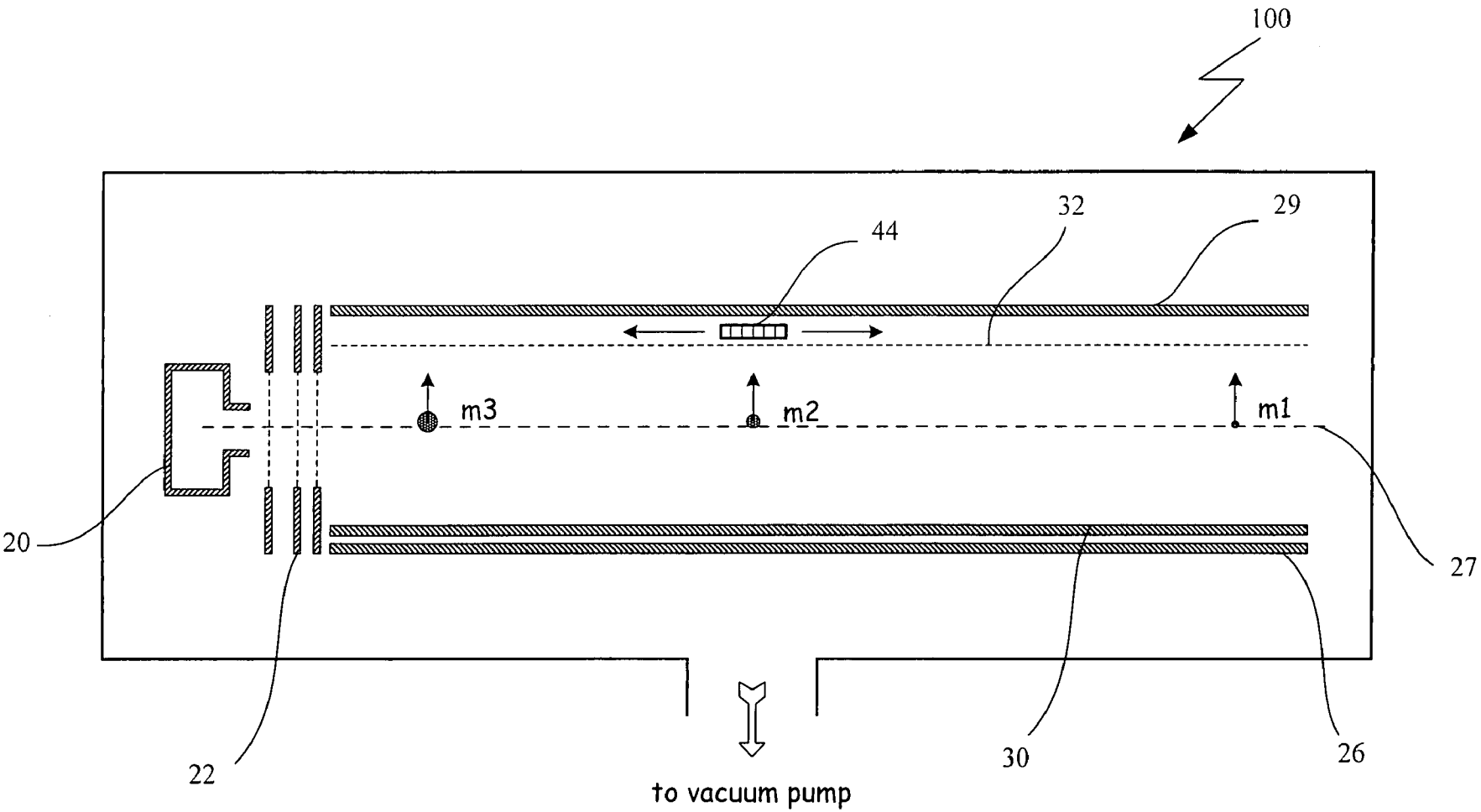
FIG. 4 is a schematic diagram of an embodiment of the time-of-flight mass spectrometer of the invention having a movable detector at the time of application of an electric pulse to the ion detection pulser electrode.

FIG. 4 shows another exemplary embodiment of the invention. In the embodiment of FIG. 4, the position-sensitive detector 44 has a length substantially less then the length of the flight tube 26. The position-sensitive detector 44 is movable in a direction that parallels the main axis 27 of the flight tube 26. An exemplary use of this embodiment is for a sample containing few components or only few a components of interest. The detector can be moved to a particular position to detect a particular component. This facilitates analysis in which one particular ion is the focus of the analysis, for example.

Figure 6:
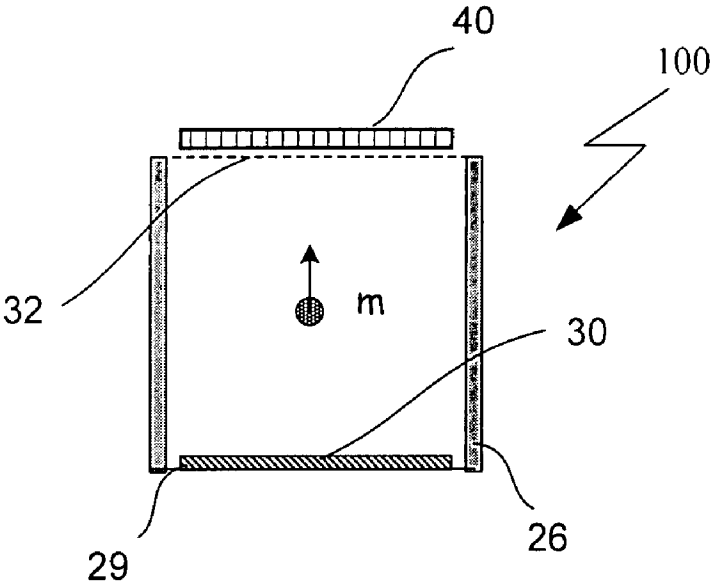
FIG. 6 is a cross sectional schematic of one embodiment of the time-of-flight mass spectrometer of the invention, at the time of application of an electric pulse to the ion detection pulser electrode.
Figure 5:
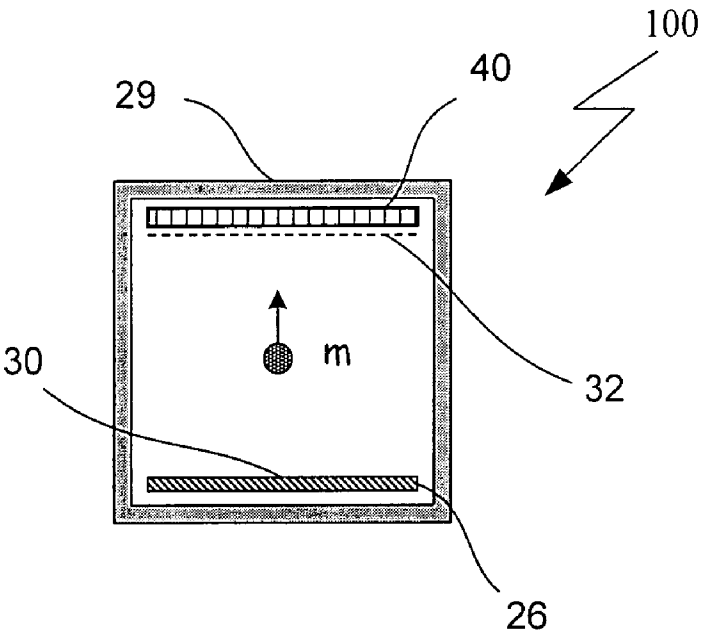
FIG. 5 is a cross sectional schematic diagram of one embodiment of the time-of-flight mass spectrometer of the invention at the time of application of an electric pulse to the ion detection pulser electrode.

FIG. 5 and FIG. 6 show cross sectional schematic diagrams of two exemplary embodiments of time of flight mass spectrometer 100. In FIG. 5 the ion detection pulser electrode 30 and the grid electrode 32 are positioned inside the flight tube 26. As shown, the detector 40 may be positioned inside the flight tube wall 29 between the grid electrode 32 and the flight tube wall 29. Alternatively, the detector 40 may be an integral part of the flight tube wall 29.

FIG. 6 shows a cross sectional diagram of an embodiment of the time of flight mass spectrometer 100. In the embodiment shown in FIG. 6, the ion detection pulser electrode 30 and grid electrode 32 are integral parts of the flight tube wall 29. In the embodiment shown in FIG. 6, the voltage applied to the ion detection pulser electrode 30 is the same as that of the flight tube 26 in the first state when the ions follow a trajectory substantially parallel to the main axis 27 of the flight tube 26 and a different voltage is applied to the ion detection pulser electrode 30 to create the second state and deflect the ions in a trajectory orthogonal to their trajectory in the first state. In the second state, the ions are deflected toward the grid electrode 32 and the detector 40. Although the ion detection pulser electrode 30 is shown as a integral part of the flight tube wall structure in the embodiment depicted in FIG. 6, it should be noted that the ion detection pulser electrode 30 should be electrically isolated from the flight tube 26.

In another embodiment of the invention not shown in the figures, there is no grid electrode. In this embodiment, an ion detection pulser electrode 30 as described for other embodiments may be used (e.g., an ion detector pulser electrode 30 is positioned substantially parallel to the main axis 27 of the flight tube 26 and electrically isolated from the flight tube wall.) The ion detection pulser 30 may be an integral part of the flight tube wall 29 or positioned between the flight tube wall 29 and the trajectory of the ions as they leave the ion acceleration field 22. The at least one detector 40 is placed at a position near or in the flight tube wall 29 opposite the ion detection pulser electrode 30 such that the trajectory of the ions leaving the acceleration field 22 passes between the ion detection pulser electrode 30 and the detector 40.

In the first state in which ions follow a trajectory in the flight tube 26 substantially parallel to the main axis 27 of the flight tube 26, the voltage applied to the ion detection pulser electrode 30 is the same as that of the flight tube 26. For detection, a different voltage is applied to the ion detection pulser electrode 30 to create a second state in which at least a portion of the ions are deflected in a trajectory substantially orthogonal to the main axis 27. At least a portion of the deflected ions then impinge on the detector 40 positioned near or in the wall of the flight tube 29.

The foregoing discussion discloses and describes many exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

The invention claimed is:

1. An apparatus for analyzing ions comprising: a flight tube having a single straight longitudinal axis; a means for generating ions with a trajectory along said axis of the flight tube; a means for electrostatic deflection disposed positioned in the flight tube substantially parallel to said axis and offset from said axis in a first direction wherein the means for electrostatic deflection is controllable and has at least one first state of non-deflection and at least one second state of deflection and wherein in the at least one second state of deflection at least a portion of the ions are deflected in a direction substantially orthogonal to said axis of said flight tube wherein said deflection occurs according to a predetermined time sequence; and an ion detector positioned in the flight tube substantially parallel to said axis and offset from said axis in a second direction, opposite the first direction such that at least a portion of the ions that are deflected in the trajectory substantially orthogonal to said axis impinge on the ion detector.

2. The apparatus of claim 1 wherein the ion detector is a position sensitive detector.

3. The apparatus of claim 1 wherein the ion detector is movable in a direction parallel to said axis.

4. The apparatus of claim 1 wherein the ion detector is a segmented detector.

5. The apparatus of claim 1 wherein the means for electrostatic deflection comprises an ion detection pulser electrode placed in a position parallel to said axis of the flight tube.

6. The apparatus of claim 1 wherein the means for electrostatic deflection comprises a first electrode and a second electrode each positioned parallel to said axis and spaced apart such that the ions with the trajectory along said axis substantially pass between the first electrode and the second electrode.

7. The apparatus of claim 6, wherein the first electrode is an ion detection pulser electrode and the second electrode is a grid electrode.

8. The apparatus of claim 6 wherein the ion detection pulser electrode is electrically isolated from the flight tube.

9. A method of analyzing ions by utilizing the time-of-flight of ions from a source region to a detection region comprising:

providing a flight tube, an ion electrostatic deflector and an ion detector, the flight tube having a single straight longitudinal axis, the ion deflector located in the flight tube substantially parallel to said axis and offset therefrom in a first direction, the ion detector located in the flight tube substantially parallel to said axis and offset therefrom in a second direction, opposite the first direction;

directing ions along said axis of the flight tube;

deflecting at least a portion of the ions towards the ion deflector, said deflecting creating deflected ions wherein the deflected ions travel along a direction having a component substantially orthogonal to said axis of the flight tube to said ion detector and wherein said deflecting occurs according to a predetermined time sequence; and detecting the arrival of the deflected ions to the detection region at the ion detector.

10. The method of claim 9 further comprising detecting the position of the arrival of deflected ions in the detection region.

11. The method of claim 9 wherein the detection region comprises a plurality of detectors.

12. The method of claim 9 wherein the deflecting of at least a portion of the ions is controllable.

13. The method of claim 12 wherein the deflecting is pulsed.

14. The method of claim 13 wherein the deflecting is pulsed in synchronization with generating the ions.

15. The method of claim 9 wherein an ion detection pulser electrode electronically isolated from the flight tube creates the deflected ions.

16. The method of claim 9 wherein the at least one set of electrodes has a first electrode and a second electrode which are positioned in the flight tube substantially parallel to said axis of the flight tube and wherein the first and the second electrode are spaced apart such that the ions traveling in a trajectory substantially along said axis of the flight tube pass substantially between the first and second electrodes.

17. An apparatus for detecting ions in a flight tube of a time-of-flight mass spectrometer comprising:

a flight tube having a single straight longitudinal axis; a controllable electrode disposed parallel to said axis of the flight tube and offset from said axis in a first direction, wherein the controllable electrode has at least one state which deflects ions in the flight tube from a direction of flight substantially along said axis to a direction having a component substantially orthogonal to said axis of said flight tube wherein said deflection occurs according to a predetermined time sequence; and an ion detector positioned in the flight tube substantially parallel to said axis and offset from said axis in a second direction, opposite to the first direction, wherein the ion detector is positioned to receive ions deflected by the controllable electrode.

18. The apparatus of claim 17, further comprising a means for generating ions and a means for synchronizing the state of the controllable electrode with the means for generating ions.

* * * * *